United States Patent [19]

Goodwin et al.

[11] Patent Number: 5,008,839

[45] Date of Patent: Apr. 16, 1991

[54] SPORTS TRAINING APPARATUS

[76] Inventors: John D. Goodwin; Samuel D. Goodwin, both of 1605 Slattery Bldg., Shreveport, La. 71101; Wilford House, 506 Pineacres Dr., Shreveport, La. 71107; James Farrar, 727 Unadella, Shreveport, La. 71106

[21] Appl. No.: 312,079

[22] Filed: Feb. 16, 1989

[51] Int. Cl.[5] ..... G06F 15/44; A63B 69/00

[52] U.S. Cl. ..... 364/550; 273/25; 273/183 R; 364/410; 364/569; 368/109; 368/251; 434/247; 434/255

[58] Field of Search ..... 364/200, 900, 410, 411, 364/550, 556, 569; 272/100, 105; 273/1 GE, 1.5 A, 25, 26 R, 183 R; 368/89, 98, 107, 109, 111, 251; 434/247, 248, 251, 255

[56] References Cited

U.S. PATENT DOCUMENTS

| | | | |
|---|---|---|---|
| 4,395,760 | 7/1983 | Soski et al. | 364/411 |
| 4,428,050 | 1/1984 | Pellegrino et al. | 364/569 |
| 4,538,235 | 8/1985 | Henning | 364/569 |
| 4,627,620 | 12/1986 | Yang | 273/1 GE |
| 4,834,375 | 5/1989 | Elstein et al. | 273/26 R |

FOREIGN PATENT DOCUMENTS

| | | | |
|---|---|---|---|
| 8805323 | 7/1988 | World Int. Prop. O. | 434/251 |

*Primary Examiner*—Kevin J. Teska
*Attorney, Agent, or Firm*—Hubbard, Thurman, Tucker & Harris

[57] ABSTRACT

A sports training apparatus for injecting actual game timing into team practice includes a portable housing having an on/off switch, a skill level selection switch, an area selector switch for selecting position areas for practice, and two time sequence initiator switches. A light and a horn are attached to the housing for signaling a running of a time sequence, and the end of the time sequence, respectively. A programmable controller is mounted in the housing and connected to the above mentioned switches and light and horn. For baseball, the programmable controller is programmed with up to 29 speed time sequences including those for infielder, outfielder, and steal position areas for pre-high school, high school, college, and professional skill levels. For the infielders and outfielders each are provided two time sequences for practicing plays as follows. For the infield, one is for practicing a play for throwing out a batter going to first, and the second time sequence which is divided into two horn sounding portions is for practicing double plays. The horn first sounds the arrival of a runner at second base and then sounds the arrival of the batter at first. For the outfielders, one is for practicing a play for throwing out a runner tagging up and advancing a base after a fly ball has been caught, and the second for practicing a play for throwing out a runner advancing two bases on a hit into the outfield. For the catcher a time sequence is provided for throwing out a runner trying to steal a base.

15 Claims, 3 Drawing Sheets

SPORTS TRAINING APPARATUS

This invention relates to sports training devices and more particularly to a portable, computerized, timing apparatus with audible feedback for injection of actual game timing into team practice.

BACKGROUND OF THE INVENTION

Various computerized devices are known in which various times are set for timing events and at the expiration of the time period an audible feedback is provided as a time expired indicator. An example of such devices is a typical microwave oven. In a typical microwave oven a desired time is set into a microprocessor and an up/down counter activated to count either from zero up to the set time or down from the set time to zero to actuate an audio circuit for producing an audible feedback indication of the expiration of the time period.

However, for sports, no known portable timing-device with audible feedback exists to assist coaches in determining whether a player's execution of a play is timely or from which a player can determine whether his or her execution is timely. For example, during a typical baseball practice, a coach may follow the routine of hitting baseballs to his infielders and catcher who in turn are supposed to catch the ball and throw out an imaginary runner running from home plate to first base. This routine may be followed by a second routine where the infielders throw to an infielder covering second base to throw out an imaginary runner running from first to second and the infielder covering second base relays the ball to first base to throw out an imaginary runner going to first base to complete a double play. This may be followed by a third routine where the coach hits baseballs to the outfielders who catch them and either throw directly to a selected base to throw out imaginary runners who having tagged up are trying to go to the selected base or they throw to a cut off man who relays the throw to the selected base to throw out the runner. In a fourth routine the outfielders field hits and throw to a base in front of the imaginary runner to keep the runner from advancing. In a fifth routine the catcher receives the ball and throws to a base to throw out an imaginary runner trying to steal.

Timing problems exist in connection with football in which the quarterback must practice throwing a pass within the time generally afforded by the defensive line rushing the passer. Similar timing problems exist in practically all of the team sports.

The problem with practicing these sports is that the players using various techniques to make these plays have no realistic time goals to meet. Thus, there is no incentive for the players to improve or change their practice techniques and no definitive way for the coaches to determine a player's progress.

SUMMARY OF THE INVENTION

Accordingly an object of this invention is to provide a sports training device for injecting realistic game timing into team practice.

Another object of the invention is to provide a sports training device having multi-speed levels suitable for use by coaches and players of different skill levels.

Still another object of the invention is to provide a sports training device having an audio/visual analyzer capability for a team practicing a sport where timing is critical to success.

Briefly stated the sports training apparatus of this invention is a precision-built device designed to inject actual game timing into team practice.

With the use of electronic timing devices such as, for example, low cost radar speed detection devices, the time it takes for a little league, high school, college, or professional player to make a play is readily derivable for input into a microprocessor-based controller. Controllers are available which provide timing accuracy to 1/1000 of a second. An audio or visual circuit or both connect a horn or light or both to the microprocessor, hereinafter collectively referred to as a "horn". The horn is activated by the controller pursuant to commands of a program. In baseball the program of the controller is divided into a plurality of four speed levels. Each level consists of time intervals developed by observing and timing players from four age groups under actual game conditions. The times are slightly faster than the average time of all players observed in each corresponding age group. In practice the team competes with the training apparatus. When a team has developed its collective skills to a level at which it can consistently beat the horn, its members know that they can successfully make more than 93% of their plays in a game.

BRIEF DESCRIPTION OF THE DRAWINGS

Other objects and features of the invention will become more readily apparent from the following detailed description when read in conjunction with the accompanying drawings, in which.

DESCRIPTION OF THE PREFERRED EMBODIMENT

Figure 1:
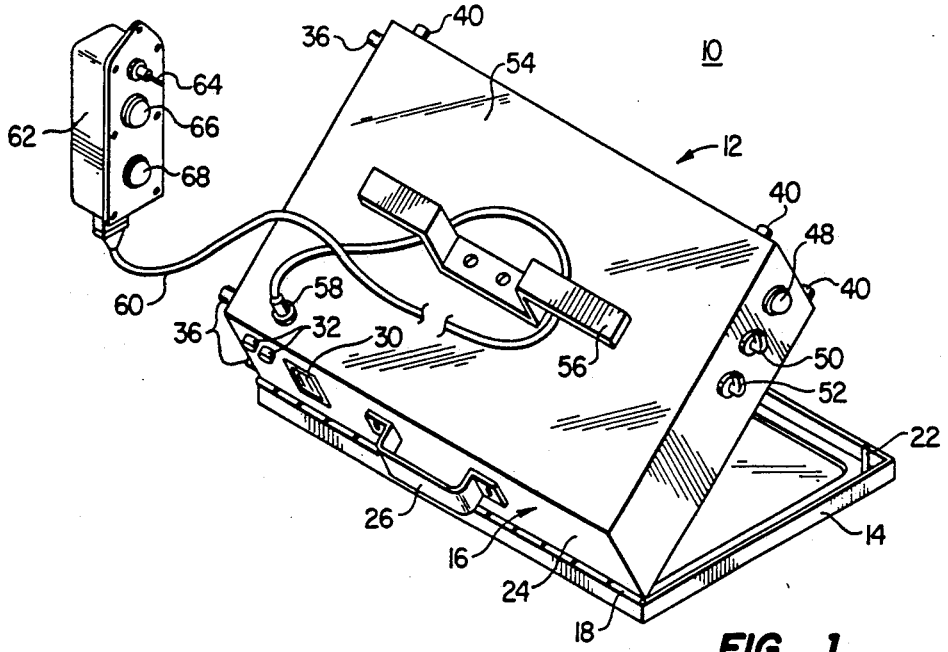
FIG. 1 is an isometric view of the sports training device of the invention.
Figure 2:
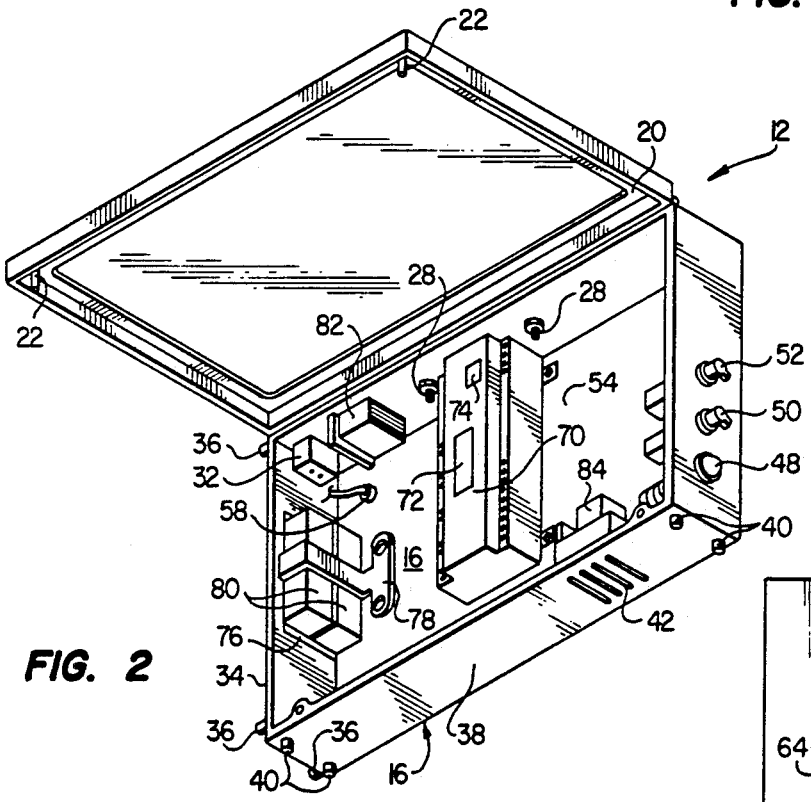
FIG. 2 is an isometric view of the sports training device of the invention in an opened condition to show in block form the details of the interior construction.

The sports training device 10 (FIG. 1) for injecting actual game timing into team practice includes a case 12 of weather proof material such as heavy duty sheet metal or a heavy duty plastic. The case or housing 12 includes a lid portion 14 and a body portion 16 having corresponding sides connected together by a hinge 18. The lid is provided with a gasket 20 (FIG. 2) for sealingly engaging the top edges of the body portion when the lid is secured thereto by screw type fasteners 22.

The hinge bearing side 24 (FIG. 1) of the body portion 16 supports a handle 26 mounted upon handle support studs 28 (FIG. 2), an ac power connector plug 30 (FIG. 1), and battery charging indicator lights 32. A side 34 (FIG. 2) of the bottom portion 16 has attached thereto case supporting feet 36. While, a side 38 opposite the hinged side also has attached thereto case supporting feet 40 whereby the case when set up for operation may have either side 34 or side 38 as bottom sides facing the case supporting media, for example, earth. Side 38 also has horn louvers 42 formed therin for passing the sound of a horn. The last or fourth side 44 includes a timing in progress indicator 48, a four position selector switch 50, and an on/off switch 52 for controlling the power applied to the timing unit. In baseball the four position selector is for selecting one of four speed levels; namely, speeds suitable for little league, high school, college, and professional players.

The bottom 54 (FIG. 1) of the body portion 16 has attached thereto a cord rack 56 and a cord connector 58. The cord connector attaches a remote control cord 60 to the bottom and the cord rack provides a storage means for the cord 60 when not in use.

A remote control 62 (FIG. 1) is attached to the remote control cord 60, and includes an area or position selector switch 64 and push button switches 66 and 68. The area selector switch 64 allows an operator to select, in baseball for example, the infield, outfield, or catcher areas for play practice. While the push button switches 66 and 68 allow the operator to make the final input to select a specific timing sequence for one of two plays in the area selected or to abort a timing sequence in progress. A more detailed description of this operation will be set forth hereinafter in connection with the operation of the device.

Figure 4:
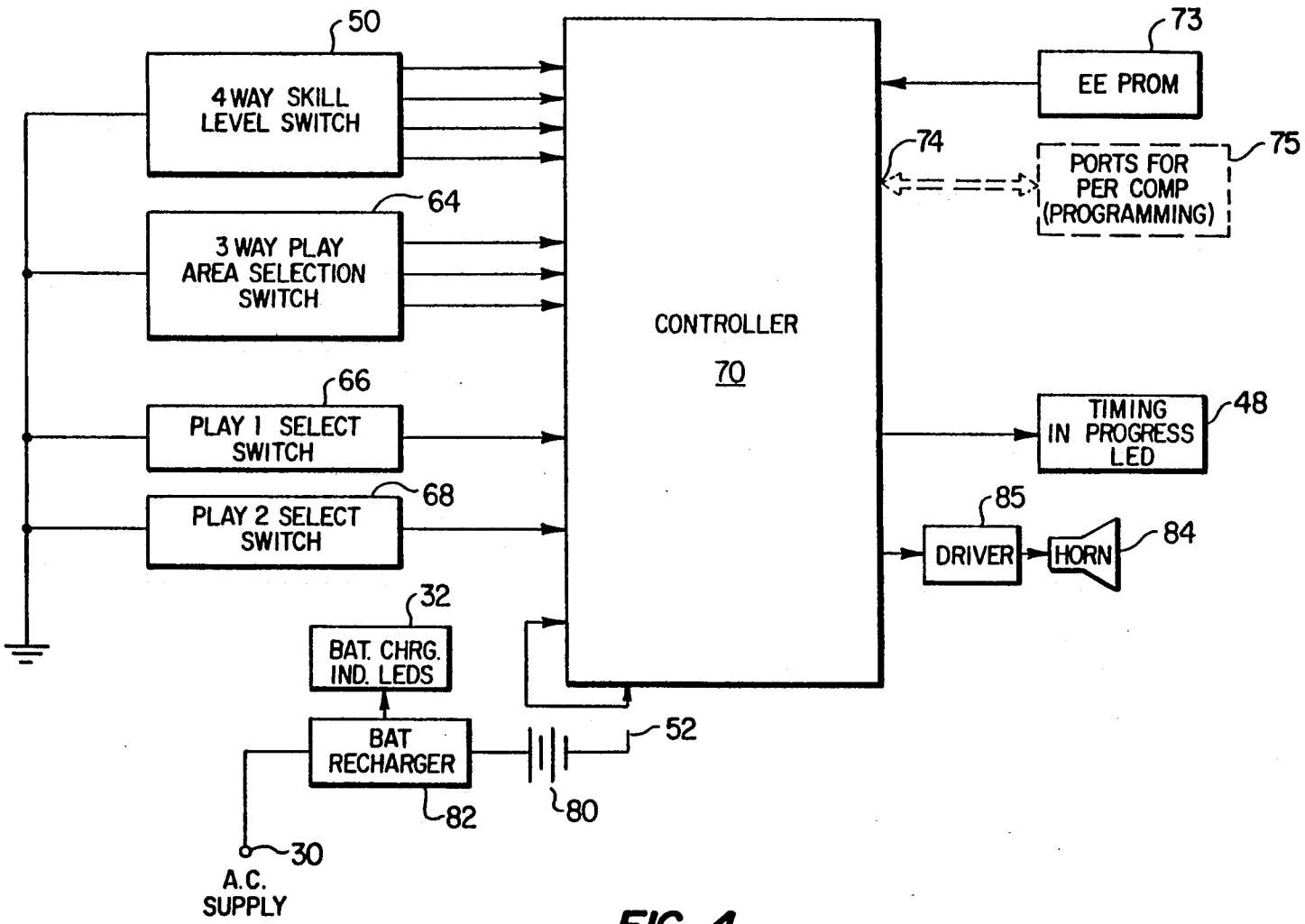
FIG. 4 is a a block diagram of the circuit for the sports training device; and flow diagram of the computer program for the sports training device of the invention.
Figure 5:
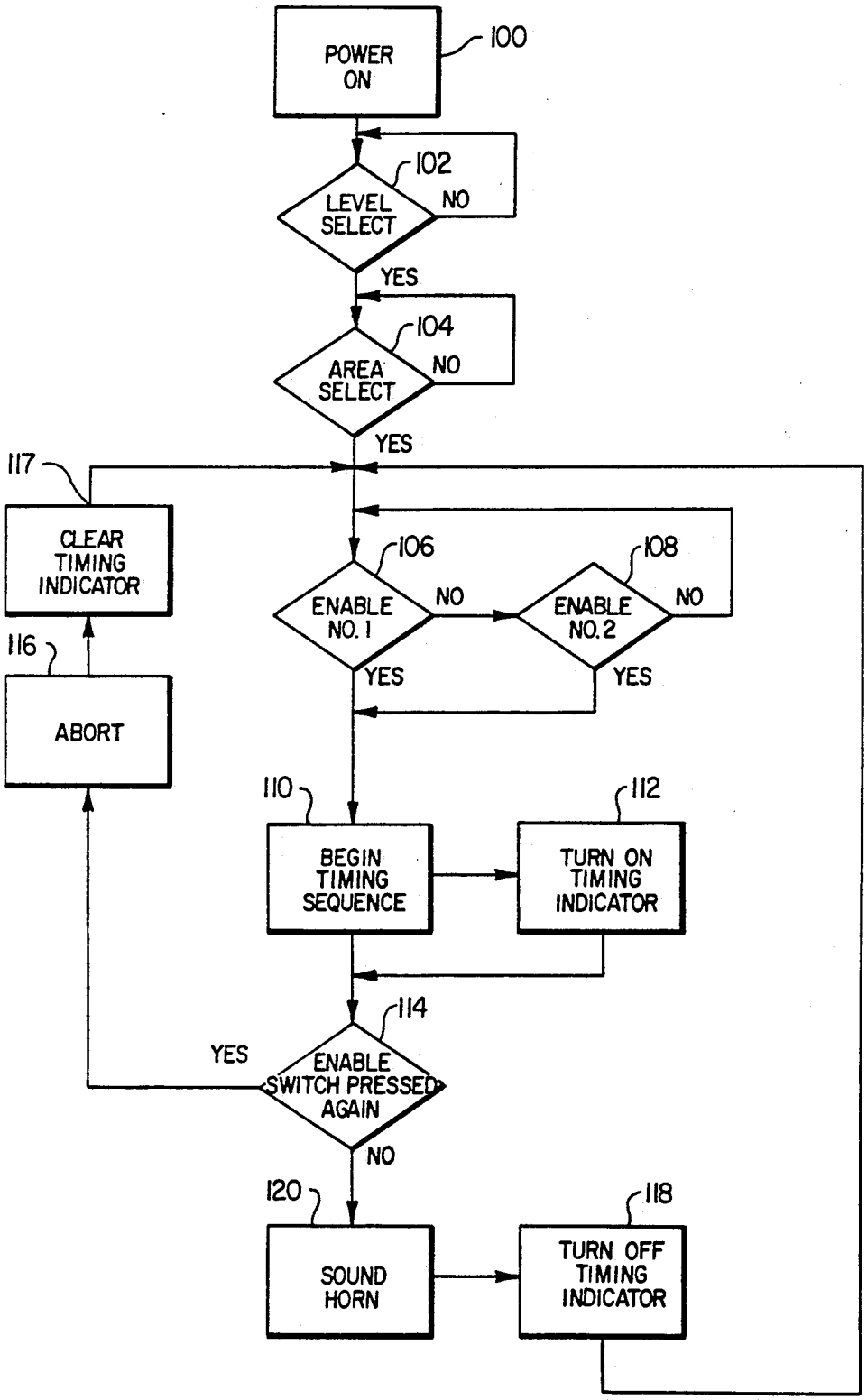
FIG. 5 is a before "flow" diagram of the computer program for the sports training device of the invention.

The interior of the body portion 16 (FIG. 2) has a control unit 70 attached to the bottom 54. A suitable controller is the Allen-Bradley Company SLC 100. The control unit 70 (FIG. 4) has an EEPROM port 72 for connection to an EEPROM 73 containing the program for a selected sport and a programming port 74. The programming port permits the connection of a personal computer 73 to the control unit for entering or changing the operating program of the EEPROM. A battery guide 76 mounted on side 34 coacts with a battery hold down bracket 78 attached to the bottom portion to support a rechargable battery power source 80. This power source is connected to the control unit through the on/off switch 52 for selectively powering on and off the control unit. A battery recharger 82 is connected to the ac voltage connector 30 and battery power source for recharging the battery source. Battery charging lights 32 connected to the battery indicate when the battery source needs recharging and the recharging of the battery power source for the control unit. A horn 84 is connected through a driver 85 to the controller and attached to the side 38 behind the louvers 42.

The control unit 70 has sense circuits connected to the four position selector 50, on/off switch 52, area selector 64, and enable push button switches 66 and 68 for informing the control unit of their condition or position. The control unit 70 has output control circuits connected to the timing indicator light 48 and to the horn 84. The timing indicator light 48 is controlled by the control unit to shine during a timing sequence, and the operation of the horn is controlled by the control unit to indicate the end of the timing sequence. If desired a light can either replace the horn or be added to provide the audio/visual analyzer.

It will be appreciated, that a control panel 86 (FIG. 3) containing selected operating switches can either be mounted in a side of the body portion 16, or in the remote control unit 62 or both. When located in the case and in the remote control unit the cord for the remote control unit is a plug in type which when inserted into a jack provided therefor deactivates the operation of the front panel on the case. The control panel 86 as shown includes the four speed level selection switch 50, the on/off switch 52, the area selection switch 64 and the play enable push button switches 66 and 68. It will be appreciated that the indicator light 48 indicating a timing sequence in progress can also be included in the panel for use in either location of the panel.

In describing the operation of the sport training device, a baseball training apparatus will be used for purposes of description only and not by way of limitation. For baseball, the area selection switch has its three positions labeled "INFIELD", "OUTFIELD", and "STEAL".

During set up, first the speeds for the four speed levels (skill levels) are entered into the EEPROM of the control unit, or an EEPROM chip containing the program is plugged into the control unit. The speeds are those disclosed in Table 1. Table 1 has its columns labeled with the four skill levels, (PRE-HS) pre-high school, (HS) high school, (COL) college, and (PRO) professional, and its rows of speeds labeled infield play 1, infield play 2, outfield play 1, outfield play 2, and steal. Steal is for the "catcher" position.

TABLE 1

| | Pre-H.S. | H.S. | Col. | Pro. |
|---|---|---|---|---|
| Infield Play 1 | 4.3 | 4.5 | 4.3 | 4.1 |
| Infield Play 2 | 3.5 | 3.6 | 3.4 | 3.3 |
| | 4.3 | 4.5 | 4.3 | 4.1 |
| Outfield Play 1 | 4.2 | 3.9 | 3.8 | 3.7 |
| Outfield Play 2 | 7.4 | 7.4 | 7.2 | 7.0 |
| Steal | 1.7 | 1.6 | 1.5 | 1.3 |
| | 3.4 | 3.5 | 3.3 | 3.1 |

Infield play number 1 provides the speed it takes for an imaginary batter to reach first base after he has hit the ball. In order to get credit for an "out" the fielders must throw the ball to first base before the horn or light or both, hereinafter considered collectively in the word "horn", indicates that the time interval has expired and the baserunner has reached first base. The controller starts the timing sequence when the operator presses the play/button 66 at the instant the bat contacts the ball.

Infield play number 2 provides two speeds for a double play scenario where the batter is up with a runner on first base. The control unit using the first speed time will indicate when the time interval has expired for the lead runner to reach second base by sounding the horn, and the second speed time to sound the horn to indicate that the batter has reached first base. In order to get credit for two "outs", the fielders must throw the ball to second base, and then to first base before the respective time intervals expire as indicated by the horn. The controller of course is activated the instant the ball touches the bat.

Outfield play number 1 provides the speed time it takes for a runner to tag and advance a base after a fly ball has been caught in the outfield. In order to get credit for an "out", the fielder must throw the ball to the designated base to which the runner is advancing, and the baseman must put the ball in a tag position before the horn sounds indicating that the time interval has expired. The timing begins the instant the ball touches the fielder's glove.

Outfield play number 2 provides the speed time it takes a runner to advance two bases on a hit into the outfield. In order to get credit for an out the fielders must throw the ball to the designated base to which the runner is advancing, and the baseman must put the ball in a tag position before the horn indicates that the time interval has expired. Again, the control unit timer is activated the instant the ball touches the bat.

The steal selection provides three speed times: the first to notify the fielders that the runner is going; the second to indicate the time allocated for the pitcher to deliver the ball to the catcher; and, the third to indicate the time that it takes a runner to steal a base. In the steal scenario, the controller timer is activated the instant the pitcher starts his move to throw the ball to the catcher. The controller sounds the horn at this time to notify the fielders that the runner is attempting to steal a base. To get credit for an "out", the catcher must throw the ball to the designated base that the runner is attempting to steal, and the baseman put the ball in a tag position before the third horn sounds.

The coach indicates to the operator the area of play and the play selection, the operator sets the area selection switch 64 to the area requested i.e. infield, outfield, or steal and stands by to press either the first or second play push buttons as required. Assuming for purposes of operation description the coach has called for the infielders to get one "out". The operator sets the switch 64 to INFIELD and makes ready to press the play 1.

When the coach hits a ball to an infielder, at the crack of the bat the operator presses the push button switch 64 and the timing begins. If, for example, the infielder misses the ball, the operator presses the button again to abort the play and the controller resets the timer. However, if the infielder catches the ball and throws the ball to first the button is not pressed a second time, but at the expiration of the speed time the horn is automatically sounded by the controller and the control units timer reset to zero. If the ball is in the first baseman's glove prior to the horn sounding, the fielder has thrown the runner out; otherwise, the runner is safe.

Figure 3:
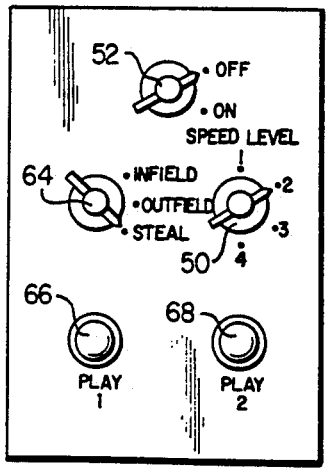
FIG. 3 is a view of an operation panel for the sports training device.

Referring now to FIG. 3, the control unit upon initialization by power on 100 makes a decision 102 whether a level selection has been made. If No, the decision is repeated until a level selection has been made; if Yes, a decision 104 is made whether an area selection has been made. If No, the decision is repeated until an area selection has been made; if Yes, a decision 106 is made whether the enable number one switch has been pressed. If No, a decision 108 is made whether the enable number two switch has been pressed. If neither of the enable switches have been pressed the decisions 106 and 108 are continued until one of the switches has been pressed. If either of decisions 106 or 108 is Yes, instructions 110 and 112 are issued to begin the timing sequence, and turn on the timing indicator light, respectively. Next, a decision 114 is made whether the pressed enable one or two switch has been pressed again during the timing interval. If Yes, instructions 116 and 117 is issued to abort and clear the timing sequence and return to decisions 106 and 108 and await either enable one or enable two switch pressing; if No, instructions 118 and 120 are issued, respectively, to turn off the timing indicator and to activate the horn for a preselected time.

The timing sequence based upon selections of level, area and enable switch selection selects one of up to 29 individual timing sequences such as those of Table 1.

Although several embodiments of this invention have been described, it will be apparent to a person skilled in the art that various modification to the details of construction shown and described may be made without departing from the scope of this invention.

What is claimed is:

1. A sports training apparatus for injecting actual game timing into team practice comprising:

an on/off means for powering on the apparatus; a skill level selector means for selecting a skill level from a group consisting of pre-high school, high school, college, and professional skill levels; an area selector means for selecting an area from a group consisting of infield, outfield and catcher areas for corresponding play practice; and a plurality of play selection and initiation means for producing a play selection and play initiation signal;

a signaling means for producing a signal indicating a time period for completing the selected play has expired; and a control means having a memory means for storing information including a plurality of skill levels and time periods for each of the skill levels, a timing means connected to the memory means for receiving time periods and outputting signals indicative of the expiration of the time periods, a plurality of sense circuits for connecting the controller to: the on/off means for sensing power on, the skill level selector means for sensing the skill level selection, the area selector means for sensing the area selection, and the plurality of play selection and initiation means for sensing a play selection; an information fetching means connected to the memory means and responsive to the outputs of the skill level selector means, area selector means, and play selection and initiation means sense circuits for fetching the corresponding time period for the timing means and initiating the timing means for timing the time period, said timing means including a signal producing means connected to the signaling means for outputting a signal to the signaling means whereby the signaling means is activated to signal the expiration of the time period for use in determining the timely completion of the play.

2. A sports training apparatus according to claim 1 further including means connected to the signal producing means of the timing means for indicating timing is in progress.

3. A sports training apparatus for injecting actual game timing into team practice comprising:

a plurality of operation selector means for establishing selected ones of a plurality of operating condition possibilities and for selecting a desired speed time, said plurality of operation selector means including: an on/off switch; a skill speed level selector means including a switch having pre-high school, high school, college, and professional skill speed level positions; an area selector means; and a plurality of play initiation means;

a signal means for signaling expiration of the selected speed time; and a control means connected to the plurality of operation selector means and the signal means, said control means including a memory means of storing a plurality of speed times for a plurality of team position training plays and skill speed levels, means for calling a selected speed time from memory in response to said plurality of operation selector means, a timing means for timing the selected speed time, and a signal driving means connected to the signal means for driving the signaling means to indicate the end of the speed time.

4. A sports training apparatus according to claim 3 wherein the area selector means is a switch having infield, outfield, a steal selection positions.

5. A sports training apparatus according to claim 3 wherein the signaling means is a horn.

6. A sports training apparatus according to claim 3 further including a means connected to the timing means for indicating that a timing sequence is in process.

7. A sports training apparatus according to claim 3 further including a portable housing for the plurality of operation selector means, signal means, and control means.

8. A sports training apparatus according to claim 3 further including a remote control means having selected ones of the plurality of operation selector means mounted therein.

9. A sports training apparatus according to claim 8 wherein the selected ones of the plurality of operation selector means of the remote control means include the area selector means and the plurality of play initiation means.

10. A sports training apparatus according to claim 9 wherein the remote control means further includes a means for indicating that a timing is in progress.

11. A method for injecting actual game timing into a sports team practice session consisting of steps as follows:

powering on a sports training apparatus; setting the apparatus to a skill level of a plurality of skill levels selected from a group consisting of pre-high school, high school, college, and professional skill levels;

setting the apparatus to a field position area of a plurality of field position areas for practice; and enabling the appartus for a play timing sequence selected from a plurality of play timing sequences for the skill level and field position area selected and signaling the end of the timing sequence.

12. A method for injecting actual game timing into a sports team practice session according to claim 11 further including a step of aborting the timing sequence after a broken play.

13. A method for injecting actual game timing into a sports team practice session according to claim 11 wherein the step of selecting field a position area from a plurality of positions areas for practice includes selecting field a position area from a group consisting of infield, outfield, and catcher.

14. A method of injecting actual game timing into a sports team practice session according to claim 13 wherein the step of enabling a timing sequence selected from a plurality of timing sequences for the position area selected includes:

for the infield selecting either a time sequence for the time it takes a batter of the selected skill level to go from home plate to first base for single out play practice, and signaling the end of the timing sequence by sounding a horn, or selecting a time sequence for the time it takes a runner going to second base from first base and signaling the end of that portion of the timing sequence by sounding a horn, and the time it takes a runner to go to first base from home plate and signaling the end of that portion of the time sequence by sounding a horn for double out play practice; and for the outfield selecting either a time sequence for the time it takes a runner to tag and advance a base after a fly ball has been caught in the outfield and signaling the end of the time sequence by sounding the horn, or a time it takes for a runner to advance two bases on a hit into the outfield and signaling the end of the time sequence by souding the horn for outfield practice.

15. A method of injecting actual game timing into a sports team practice session according to claim 13 wherein the step of enabling a timing sequence selected from a plurality of timing sequences for the field position area selected includes: for a catcher, selecting a steal timing sequence for the time it takes a pitcher to throw a ball to the catcher and the time it takes the catcher to throw the ball to a selected base, and signaling the start of an imaginary runner trying to steal a base and the arrival of the imaginary runner at the selected base.

* * * * *